US011148446B2

(12) United States Patent
McNestry et al.

(10) Patent No.: US 11,148,446 B2
(45) Date of Patent: Oct. 19, 2021

(54) TAPE DRIVE AND ASSOCIATED SPOOL

(71) Applicant: Videojet Technologies Inc., Wood Dale, IL (US)

(72) Inventors: Martin McNestry, Heanor (GB); Steven John Buckby, Bleasby (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 267 days.

(21) Appl. No.: 15/748,720

(22) PCT Filed: Jul. 29, 2016

(86) PCT No.: PCT/GB2016/052334

§ 371 (c)(1),
(2) Date: Jan. 30, 2018

(87) PCT Pub. No.: WO2017/021704

PCT Pub. Date: Feb. 9, 2017

(65) Prior Publication Data

US 2019/0009596 A1 Jan. 10, 2019

(30) Foreign Application Priority Data

Jul. 31, 2015 (GB) ..... 1513541

(51) Int. Cl.
*B41J 33/52* (2006.01)
*B41J 35/28* (2006.01)
(Continued)

(52) U.S. Cl.
CPC ..... *B41J 33/52* (2013.01); *B41J 17/32* (2013.01); *B41J 33/00* (2013.01); *B41J 33/26* (2013.01); *B41J 35/08* (2013.01); *B41J 35/28* (2013.01)

(58) Field of Classification Search
CPC ..... B41J 33/52
(Continued)

(56) References Cited

U.S. PATENT DOCUMENTS 4,798,490 A * 1/1989 Watanabe ..... B41J 33/003 400/223
4,815,875 A * 3/1989 Richardson ..... B41J 3/4075 400/208.1
(Continued)

FOREIGN PATENT DOCUMENTS

CN 1319050 A 10/2001
CN 1355102 A 6/2002
(Continued)

OTHER PUBLICATIONS

Search Report for GB1513541.1, dated Feb. 2, 2016, 7 pages.

*Primary Examiner* — Anthony H Nguyen
(74) *Attorney, Agent, or Firm* — Wolter Van Dyke Davis, PLLC; Robert L. Wolter

(57) ABSTRACT

A tape drive comprises a spool support (30) for supporting a tape spool (32), wherein the spool support comprises a support surface (34) mounted to a tape drive base plate (36) such that the support surface (34) is fixed against rotation relative to the base plate (36), the support surface (34) being configured such that, in use, as tape is removed from or wound onto the spool (32), the spool (32) rotates relative to the spool support (30) such that the spool (32) rotates around the support surface (34).

19 Claims, 4 Drawing Sheets

(51) Int. Cl.

| | |
|---|---|
| ***B41J 17/32*** | (2006.01) |
| ***B41J 33/00*** | (2006.01) |
| ***B41J 33/26*** | (2006.01) |
| ***B41J 35/08*** | (2006.01) |

(58) Field of Classification Search
USPC ..... 400/223
See application file for complete search history.

(56) References Cited

U.S. PATENT DOCUMENTS 5,370,470 A 12/1994 Kim
5,399,036 A * 3/1995 Yamaguchi ..... B41J 33/16 400/234
5,641,130 A * 6/1997 Weisser ..... G11B 15/32 242/356.5
6,042,039 A * 3/2000 Furuya ..... B41J 15/02 242/348
6,478,486 B1 11/2002 Ando
6,629,791 B2 * 10/2003 Penzo ..... B41J 32/00 347/217
7,857,532 B2 * 12/2010 Takatsuka ..... B41J 35/36 400/208
7,959,367 B2 * 6/2011 Mushimoto ..... B41J 2/32 400/234
8,550,732 B2 * 10/2013 Onozato ..... B41J 2/0057 400/236
2012/0027485 A1 * 2/2012 Suva ..... B41J 3/36 400/207
2012/0045266 A1 * 2/2012 Watson ..... B41J 15/042 400/223
2013/0221149 A1 * 8/2013 Sodeyama ..... B41J 15/044 242/422
2017/0190195 A1 * 7/2017 Kosuge ..... B41J 15/044

FOREIGN PATENT DOCUMENTS

| | | | |
|---|---|---|---|
| CN | 1535397 | A | 10/2004 |
| CN | 101039807 | A | 9/2007 |
| DE | 2742974 | A1 | 3/1979 |
| EP | 0410259 | A1 | 1/1991 |
| EP | 0684143 | A2 | 11/1995 |
| EP | 1066974 | A1 | 1/2001 |
| EP | 1500517 | A1 | 1/2005 |
| GB | 2160176 | A | 12/1985 |
| GB | 2251216 | A | 7/1992 |
| JP | H1148565 | A | 2/1999 |
| JP | 2007083437 | A | 4/2007 |
| WO | 200222371 | A2 | 3/2002 |

* cited by examiner

TAPE DRIVE AND ASSOCIATED SPOOL

This invention relates to a tape drive. In particular, the tape drive may form part of a printing apparatus. Furthermore, the invention relates to operation methods relating to tape drives and printing apparatus. Finally, the invention relates to a spool of tape which may be utilised with a tape drive or printing apparatus.

A tape drive is an apparatus which is configured to drive tape along a desired tape path. It is common that the tape path extends between a supply spool and a take-up spool such that the tape drive drives the tape from the supply spool to the take-up spool. Tape is usually pre-wound onto the supply spool and the tape drive winds the tape along the tape path and onto the take-up spool.

A printing apparatus may include a tape drive. For example, a known type of printing apparatus is a thermal transfer printer, in which a tape, which is normally referred to as a print ribbon, is used to transport ink. In particular, the print ribbon may carry ink on it. In use, a tape drive of the printing apparatus transports the print ribbon from a supply spool to a take-up spool via a print head. The print head interacts with the print ribbon so as to cause the ink on the print ribbon to be transferred from the print ribbon onto a target substrate—for example paper, cardboard, or a flexible film.

In one known type of transfer printer the ink may be carried on a first side of the print ribbon and the print head contacts the underside of the print ribbon so as to cause the ink to be transferred from the print ribbon onto the target substrate.

Printers of this type are used in many applications. Industrial printing applications include thermal transfer label printers and thermal transfer coders which print directly onto a substrate such as packaging materials manufactured from flexible film or card. In addition, such printers may form part of a labelling machine which prints onto a label which is subsequently dispensed and applied by the labelling machine onto a target article.

Ink ribbon is normally delivered to an end user of a printing apparatus in the form of a roll wound onto a core. The end user of a printing apparatus of the type previously discussed pushes a core of ink ribbon onto a spool support, pulls a free end of a roll of ink ribbon wound onto the core to release a length of ribbon, and then fixes the free end of the tape to a further spool support (the take up spool support). The print apparatus usually includes a transport means for driving at least one of the two spools so as to unwind ribbon from one spool (the supply spool) and to take up ribbon on the other spool (take-up spool).

Known tape drives are particularly concerned with accurately controlling the position of the print ribbon and accurately controlling the tension within the print ribbon.

The applicant has realised that there is a market for a different type of printing apparatus. In particular, whilst the majority of development in the state of the art of tape drives and printing apparatus has been directed towards developing more accurate/more efficient apparatus, there is a market for the development of a tape drive which provides an alternative to the present tape drives and printing apparatus which is low cost.

The present invention seeks to provide such an alternative tape drive or printing apparatus which is of relatively low cost. In addition, the present invention attempts to provide corresponding alternative methods of operation and an alternative spool for use with such tape drives and print apparatus.

According to a first aspect of the invention there is provided a tape drive comprising a spool support for supporting a tape spool, wherein the spool support comprises a support surface mounted to a tape drive base plate such that the support surface is fixed against rotation relative to the base plate, the support surface being configured such that, in use, as tape is removed from or wound onto the spool, the spool rotates relative to the spool support such that the spool rotates around the support surface.

By enabling the spool the spool to rotate relative to the spool support such that the spool rotates around the support surface this means that the spool support can be fixed to the base plate without an intermediate bearing. This reduces the complexity of the tape drive, thus making it easier and cheaper to produce and maintain, as well as more reliable.

The spool support may be a supply spool support for supporting a supply tape spool. The supply spool support may include a braking arrangement, the braking arrangement being configured to apply a braking force to the supply spool and thereby resist relative rotation between the supply spool and the supply spool support. Because the braking force resists rotation of the supply spool, the braking force may also be referred to as a braking torque.

The braking arrangement may include a braking contact which is configured to contact a portion of a supply spool supported by the supply spool support to thereby apply said braking force to the supply spool. The braking contact may protrude beyond the support surface so as to contact the portion of a supply spool supported by the supply spool support to thereby apply said braking force to the supply spool. In other embodiments the braking arrangement may include a braking contact provided on a spool supported by the spool support protrudes so as to contact a portion of the spool support to thereby apply said braking force to the supply spool.

The portion of the supply spool contacted by the braking contact may be formed from a material which is less hard than that of the braking contact such that, in use, the braking force causes the portion of the supply spool contacted by the braking contact to wear in preference to the braking contact. Put another way, the braking contact may be configured such that it is formed from a material which is more hard than the material from which the portion of the supply spool contacted by the braking contact is formed such that, in use, the braking force causes the portion of the supply spool contacted by the braking contact to wear in preference to the braking contact. Put a further way, the braking contact may be configured such that it is formed from a material which is more wear resistant than the material from which the portion of the supply spool contacted by the braking contact is formed such that, in use, the braking force causes the portion of the supply spool contacted by the braking contact to wear in preference to the braking contact.

A resilient member supported by the spool support may comprise said braking contact.

The resilient member may be a substantially planar wire spring (which may also be referred to as a wire form). In other embodiment the resilient member may take any appropriate form, e.g. it may be non-planar.

The supply spool support may be a generally cylindrical, extending along a central axis.

The spring may have first and second ends, each of which is secured to the base plate or a base portion of the supply spool support such that at least a portion of the spring is located within the generally cylindrical supply spool support and such that the plane of the spring passes through a central axis of the generally cylindrical supply spool support.

The braking arrangement may include a magnetic source. The magnetic source may be mounted to the spool support and a supported spool may comprise a magnetic member which is attracted to the magnetic source. Alternatively, the magnetic source may be mounted to a supported spool and the spool support may comprise a magnetic member which is attracted to the magnetic source.

The magnetic source may be an electromagnet. A current supplied to the electromagnet may be controllable so as to vary the magnetic force produced by the electromagnet and thereby vary the braking force exerted on the supply spool.

The tape drive may further comprise a retainer arrangement, the retainer arrangement comprising a retainer, the retainer being configured to exert a retaining force on a spool supported by the spool support which resists removal of the spool from the spool support.

The retainer arrangement may form part of the spool support. The retainer may be configured to engage an engagement feature of a supported spool to exert said retaining force on the spool which resists removal of the spool from the spool support.

Alternatively, the retainer arrangement may form part of a supported spool. The retainer may be configured to engage an engagement feature of the spool support to exert said retaining force on the spool which resists removal of the spool from the spool support.

The engagement feature may be selected from the group consisting of a recess, a flange and a shoulder The spool support may be generally cylindrical, extending along a central axis.

The retainer may comprise a resilient member. The resilient member may be a retainer spring.

The retainer may be a retainer spring and the retainer spring may have first and second ends, each of which is secured to the base plate or a base portion of the spool support such that at least a portion of the retainer spring is located within the generally cylindrical spool support and such that the retainer spring intersects a central axis of the spool support.

The resilient member of the retainer arrangement may be one and the same as the resilient member of the braking arrangement.

The retainer arrangement may include a retainer magnetic source. The magnetic source may be mounted to the spool support and a supported spool may comprise a magnetic member which is attracted to the magnetic source. Alternatively, the magnetic source may be mounted to a supported spool and the spool support may comprise a magnetic member which is attracted to the magnetic source.

The magnetic source may be an electromagnet. A current supplied to the electromagnet may be controllable so as to vary the magnetic force produced by the electromagnet and thereby vary the retaining force exerted on the spool.

The retainer magnetic source and the magnetic source of the braking arrangement may be one and the same.

According to a second aspect of the invention there is provided a tape drive comprising a spool support for supporting a spool, wherein the spool support comprises a support surface mounted to a tape drive base plate such that the support surface is fixed against rotation relative to the base plate, the support surface being configured such that, in use, the spool rotates relative to the spool support such that the spool rotates around the support surface; and wherein the spool support comprises a sensor configured to produce a sensor signal based on the rotation of the spool relative to the spool support.

The tape drive may further comprise a controller, the controller being configured to receive the sensor signal and, based on the sensor signal, produce a signal indicative of a fault condition if the sensor signal is indicative of the speed of rotation of the spool being outside of a target range.

The tape drive may further comprise a controller, the controller being configured to receive the sensor signal and, based on the sensor signal, produce a signal indicative of a spool empty condition when the sensor signal is indicative of the speed of rotation of the spool support being outside of a second target range.

The sensor may be selected from a group consisting of an optical sensor, a capacitive sensor, a magnetic sensor and a rotary encoder.

The sensor may be configured to such that the produced sensor signal is a function of a rotationally salient feature passing the sensor as the spool rotates relative to the spool support.

The spool support may be configured to support a spool which comprises a plurality of ribs which each extend in a generally radial direction inwards from an outer face of a spool core to a respective radially inner end, wherein the sensor produces said sensor signal based on the passage of each of the ribs past the sensor.

The tape drive may be a print ribbon drive such that, where applicable, the tape supply spool is a print ribbon supply spool.

According to a third aspect of the invention there is provided a printer comprising a tape drive according to either the first aspect of the invention or the second aspect of the invention. The tape driven by the tape drive may be a print ribbon.

According to a fourth aspect of the invention there is provided a tape spool for being driven by a tape drive according to any preceding claim.

According to another aspect of the invention there is provided a tape spool for being driven by a tape drive, the tape spool comprising a length of tape wound around an outer face of a generally annular central core, the core also having an inner face, radially inboard of the outer face, wherein the inner face comprises first and second portions spaced along a central axis of the core, wherein a diameter of the first portion of the inner face is greater than a diameter of the second portion of the inner face.

The spool may be configured such that an alignment feature of a spool support may be received by the first portion of the inner face, and said alignment feature cannot be received by the second portion of the inner face, when the spool is supported by the spool support, thereby allowing the spool support to fully support the spool in a first relative orientation between the spool and the spool support in which the alignment feature is received by the first portion of the inner face, and preventing the spool support from fully supporting the spool in a second relative orientation between the spool and the spool support in which the alignment feature is not received by the first portion of the inner face.

The tape spool may further comprise a retainer feature configured to exert a retaining force on the spool when the spool is supported by a spool support which resists removal of the spool from the spool support.

The retainer feature may comprise a third portion of the inner face spaced along a central axis from the first and second portions, the third portion having a diameter which is greater that at least one of the diameter of the first portion of the inner face and the diameter of the second portion of the inner face, the third portion being configured to receive a retainer of a spool support when the spool is supported by a spool support.

The second portion of the inner face may be located intermediate the first and third portions of the inner face with respect to their positions along the central axis of the core and wherein the third portion has a diameter which is greater than the diameter of the second portion.

The third portion may have a diameter which is less than the diameter of the first portion.

The retainer feature may comprise a magnetic source or a ferromagnetic material, said magnetic source or ferromagnetic material being configured to interact with a magnetic member, in the form of a second ferromagnetic member or a second magnetic source, associated with a spool support which may support the spool, such that said interaction exerts said retaining force on the spool when the spool is supported by the spool support.

The spool may comprise a plurality of ribs which each extend in a generally radial direction inwards from the outer face to a respective radially inner end, wherein the inner face is a discontinuous surface which is defined by the radially inner ends of each of the plurality of ribs.

It will be appreciated that whilst all of the aspects of the invention discussed above relate to a respective apparatus, corresponding methods of producing or operating such apparatus also falls within the scope of the invention It will be appreciated that any of the features described above in relation to a particular aspect of the invention may be applied, where appropriate, to another aspect of the invention.

Various embodiments of the present invention are now described in detail, without limitation as to the scope of the invention, in which.

Figure 1:
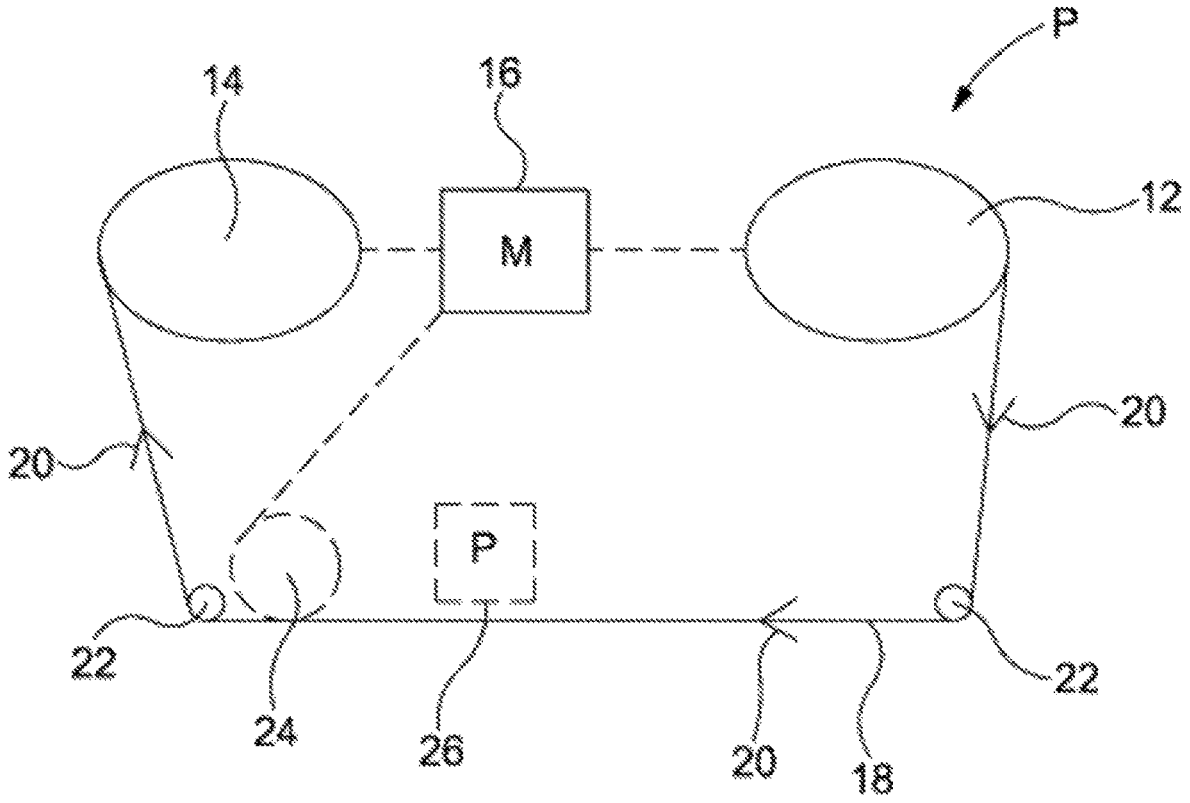
Figure 1 (prior art)
FIG. 1 shows a schematic view of a known tape drive apparatus.

FIG. 1 shows a known tape drive arrangement 10. The tape drive arrangement 10 includes a supply spool 12, and take-up spool 14 and a motive device 16. The motive device 16 drives tape from the supply spool 12 to take-up spool 14 along a tape path 18 in a direction 20. Rollers 22 help to define the tape path. It will be appreciated that, depending upon the exact configuration of the tape drive, there may be any appropriate number of rollers which serve to define the tape path.

The motive device 16 drives the tape along the tape path 20 from the supply spool 12 to the take-up spool 14. This may be achieved in one any number of known, appropriate ways. For example, the motive device may drive rotation of i) the take-up spool 14, ii) the take-up spool 14 and supply spool 12, or iii) a drive roller 24 and the take-up spool 14.

In addition, it is common for known tape drives to include some arrangement which assists in maintaining a desirable level of tension within a tape as it travels along a tape path 18. This may be achieved in any number of known ways including use of a drive roller 24 as previously discussed, use of a dancing arm and/or the use of some form of braking apparatus which acts upon the supply spool support so as to either apply a braking force to the supply spool support which opposes the rotation of the supply spool support and supported supply spool or which reduces the speed of rotation of the supply spool support and supported supply spool so that the speed of rotation of the supply spool results in the tape being fed off the supply spool at a slower speed than that at which tape is taken up onto the take-up spool 14.

In an example where the tape drive 10 forms part of a printing apparatus the tape drive 10 may drive a tape in the form of a print ribbon. In such instances, the tape path 18 may be such that the print ribbon is driven from the supply spool to the take-up spool past a print head 26.

In known tape drives it is common for the supply spool 12 and the take-up spool 14 to be supported upon respective supply and take-up spool supports. The spool supports within known tape drives are commonly configured such that each spool support is mounted to a base plate such that the spool support may rotate relative to the base plate. In this way, when the spool support is supporting a spool, a spool support and supported spool can co-rotate such that both rotate relative to the base plate to which the spool support is secured.

It is a commonly held view in the field of tape drives that spool supports which are configured to co-rotate with their supported spools are the only viable type of spool support. This is because, by making a supported spool co-rotate with the spool support, this enables the spool support to be mounted to the base plate with an appropriate form of bearing such that frictional losses caused by the necessary rotation of the spools during operation of the tape drive are minimised.

The applicant has appreciated the need for an alternative type of tape drive. In particular, this tape drive is desirably low in cost to manufacture and low in complexity—which reduces the likelihood that the tape drive will malfunction and/or facilitates easy maintenance. Such tape drives may be used in less well-established markets.

Figure 2:
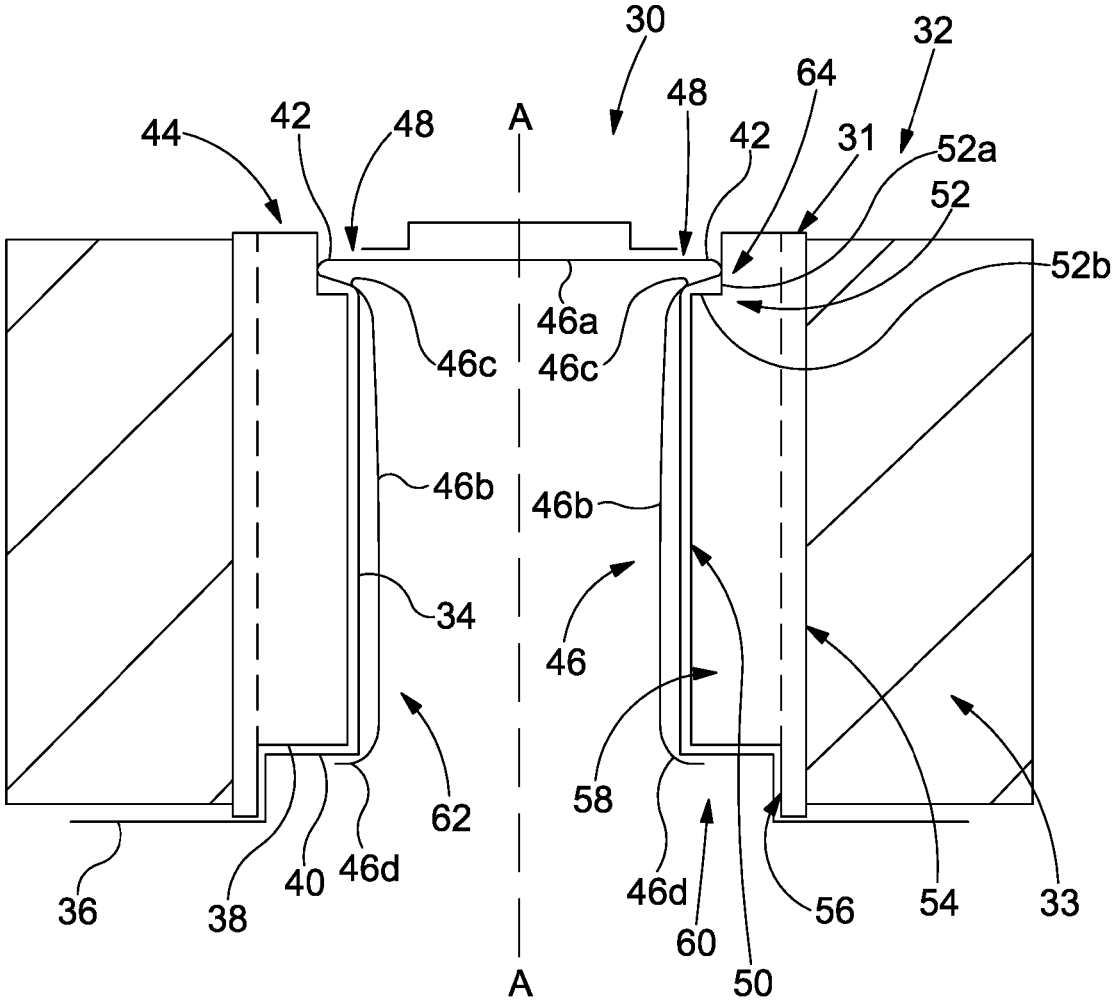
FIG. 2 shows a schematic cross section through a spool support and supported spool in accordance with various embodiments of the present invention.

FIG. 2 shows a schematic cross-section through a spool support according to an embodiment of the present invention. The spool support 30 is suitable for supporting a tape spool 32. In this case the tape spool 32 is a supply spool of the tape drive of which the spool forms part. It will be appreciated that the spool support 30 is equally capable of supporting a tape take-up spool of a tape drive. The spool support 30 comprises a support surface 34 and is mounted to a base plate 36 of the tape drive. The support surface 34 is configured such that, in use, as tape is removed from (or, in the case of a take up spool, wound onto) the supported spool 32, the spool 32 rotates relative to the spool support 30 such that the spool 32 rotates around the support surface 34. The supported spool 32 comprises a central core 31 around which tape material 33 is wound.

In the present case, the spool support 30 is generally cylindrical and extends along a central axis A. The supported spool rotates relative to the spool support 30 such that the spool 32 rotates around the central axis A.

In this situation, in which the spool support is fixed relative to the tape drive base plate and the supported spool rotates relative to a spool support (in particular the support surface of the spool support) is quite different to known spool support arrangements in which the supported spool is fixed for rotation relative to the spool support, and the support spool and spool support co-rotate (i.e. rotate with one another), relative to the base plate.

The benefit of the spool support according to the present invention is that because the spool support is fixed with respect to the base plate of the tape drive, there are no moving parts which are required to enable the supported spool to rotate. Because of this the tape drive is both easier and cheaper to manufacture. In addition, the lack of the requirement for any moving parts to facilitate rotation of a supported spool means that the tape drive is more reliable (i.e. less likely to suffer part failure).

The previously discussed support surface 34 of the spool support 30 is a generally cylindrical surface. The support surface 34 is generally parallel to the axis A of rotation. It will be appreciated that, when supported by the spool support, a generally radial surface 38 of the spool 32 is supported by a corresponding generally radial surface 40 of the spool support 30. This generally radial surface 40 is substantially perpendicular to the axis A of rotation. In some embodiments of the invention the support surface may be considered to only be a surface which is generally parallel to the axis of rotation (e.g. surface 34); in other embodiments the support surface may be considered to be a surface which is generally perpendicular to the rotation axis A (e.g. surface 40); and in some embodiments the support surface may be considered to be a combination of surfaces which are parallel to the axis A of rotation and perpendicular to the axis A of rotation.

Furthermore, in some embodiments, the support surface may not be parallel to or perpendicular to the rotation axis A. For example, in some embodiments, the support surface may be such that it extends in a direction which has a component which is parallel to the rotation axis A and a component which is perpendicular to the rotation axis A—for example the support surface may be generally frustoconical. In such an embodiment the generally frustoconical support surface is orientated such that the portion of the surface which has a relatively small diameter (with respect to the rotation axis A) is located further from the base plate 36 than the portion of the frustoconical support surface which has a relatively large diameter. In this way, when a spool is mounted onto the spool support, the frustoconical surface serves so as to guide the spool onto the spool support whilst centring the spool, with respect to the rotation axis A, on the spool support. This may be beneficial in some applications because it will enable a supported spool to be efficiently centred on the spool support and therefore enable efficient rotation of the spool on the spool support.

It will be appreciated that, unlike known spool supports, the spool support according to the present invention does not include any form of bearing to facilitate rotation of the spool. Instead, the support surface of the spool itself acts as a bearing surface which cooperates with a corresponding surface of the spool so as to facilitate rotation of the spool. It will be appreciated that because the support surface of the spool support (and corresponding surface of the spool) act as a bearing surface, there will be frictional forces which act between the support surface and the corresponding surface of the spool core. Such frictional forces may lead to wear. Because of this it is preferable that the support surface and corresponding spool core surface (or at least one thereof) are formed from a material which has a relatively low coefficient of friction. For example, the support (and hence the support surface) may be formed from acetal plastic; and the spool core (and hence the surface of the spool core) may be formed from polystyrene or another plastic material. Other examples of plastic materials from which the support or spool core may be formed include ABS Polycarbonate, PVC, Nylon, PPS (polyphenylene sulphide) and PBT (polybutylene terephthalate). Suitable materials may have a coefficient of friction between about 0.15 and 0.4. In other embodiments, at least one of the support surface of the spool support and corresponding surface of the spool core may be coated in a low friction material—for example, Teflon.

By utilising materials with a relatively low coefficient of friction for the bearing surfaces (support surface and corresponding surface of spool core), this will minimise wear of the spool support or supported spool due to friction during use.

It is also worth noting that the spool support is by its nature a permanent part of the tape drive, whereas the supported spool (and hence spool core) are consumable items which are used and then disposed of. Consequently, it will be appreciated that it is of greater importance that wear due to friction is minimised with respect to the spool support as compared to that of the core of the spool—a worn spool core will be replaced when the supported spool is replaced. Consequently, in some embodiments, the support surface of the spool support may be formed from a material which is harder than that of the corresponding surface of the core so that the surface of the core preferentially wears, in use, due to friction as compared to the support surface of the spool support. Again, examples of suitable materials are acetal plastic for the support and polystyrene for the spool core. Other examples of plastic materials from which the support or spool core may be formed include ABS Polycarbonate, PVC, Nylon, PPS (polyphenylene sulphide) and PBT (polybutylene terephthalate). Suitable materials may have a coefficient of friction between about 0.15 and 0.4.

As previously discussed, the aforementioned spool support according to the present invention may support either a supply spool or a take-up spool of a tape drive. In some embodiments of tape drive it is desirable to maintain the tension within the tape path within predetermined limits (e.g. high enough such that the tape does not go slack, but not so high that it causes the tape to undesirably stretch or break). One way of achieving this is to apply some kind of braking which resists rotation of the supply spool. The braking of the supply spool resists advancement of the tape along the tape path 18 by the motive device 16 thus resulting in an increase in tension of the tape in the tape path 18.

In light of the above, in some embodiments, a spool support according to the present invention as discussed above may be configured to support a supply spool and may include a braking arrangement, the braking arrangement being configured to apply a braking force to the supply spool and thereby resist relative rotation between the supply spool and the supply spool support (and hence between the supply spool and the base plate 36).

It will be appreciated that any appropriate braking arrangement which can apply a braking force to the supply spool to resist rotation of the supply spool may be used.

In the particular embodiment of the invention shown in FIG. 2, the braking arrangement includes a braking contact 42 which is configured to protrude beyond the support surface 34 to contact a portion 44 of the supply spool 32 supported by the supply spool support to thereby apply said braking force to the supply spool 32.

In this embodiment the braking contact takes the form of two opposed elbow portions of a resilient member 46. The resilient member 46 is supported by the supply spool support 30. In particular, in this embodiment, the resilient member 46 takes the form of a substantially planar spring formed of generally round cross-section wire. The wire may be formed of any appropriate material, for example, steel. It will be appreciated that such a suitable material may be flexible enough to accommodate a spool being mounted and/or removed from a spool support (see discussion later within this document) and may be harder than the material of the portion of the core contacted by the braking contact such that as it supplies a braking force to the core 31 of the spool 32, the friction between the braking contact 42 and the spool core is such that the core is worn in preference to the braking contact. The reasons why the core of the spool preferentially wearing as compared to the braking contact have already been discussed above in relation to the preferential wear of a supported spool core as compared to the spool support. As such, these reasons are not repeated here.

The profile of the resilient member as viewed in FIG. 2 is generally that of an upturned vase. As such, the resilient member 46 includes a base portion 46*a* from which two legs 46*b* depend via respective elbow portions 46*c* which form the braking contact 42. Tips 46*d* on each of the legs 46*b* are secured to a base portion of the supply spool support. In other embodiments the resilient member may be secured to any appropriate portion of the tape drive—for example, the resilient member may be secured to the base plate.

As such, the tips 46*d* of the resilient member 46 constitute first and second ends, each of which is secured to the base portion of the supply spool support. A portion of the spring 46 is located within the generally cylindrical supply spool support and the central axis A of the generally cylindrical spool support lies in the plane of the substantially planar wire spring. In particular, the supply spool support 30 includes a pair of diametrically opposed openings 48 through which the elbow portions 46*c* of the spring 46 which constitute the braking contact 42 protrude. The remaining portions of the spring 46 are located inside the spool support 30.

In use, when a supply spool 32 is supported by the spool support 30 the braking contact 42 contacts a portion of a core 31 of the spool 32. In the embodiments shown, the braking contact 42 contacts a portion 52 of an inner face 50 of the spool core 31. In particular, in the embodiment shown in FIG. 2, the portion 52 includes a substantially circumferential wall 52*a* and a substantially radial wall 52*b*. The Figure shows the braking contact 42 contacting the circumferential wall 52*a*.

In other embodiments the spool support and supported spool may be configured such that the braking contact contacts the radial wall in addition to, or as an alternative to, the circumferential wall. That is to say, the present invention encompasses a braking contact contacting any appropriate portion of the supported spool. For example, the portion of the spool contacted by the braking contact may be a substantially radial surface, a substantially circumferential surface, a combination of a substantially radial surface and a substantially circumferential surface, or any appropriately shaped surface. Furthermore, the present invention also encompasses that the spool support and supported spool may be configured such that the braking contact may contact any appropriately located portion of the spool core in use. For example, in the presently described embodiment the braking contact contacts an inner face of the spool core. In other embodiments the braking contact may contact an axial end of the core of a supported spool, or may contact both an axial end and an inner face of the core of the supported spool.

In addition, whilst the braking contact in the presently described embodiment takes the form of a wire spring protruding from the spool support, in other embodiments the braking contact may take any appropriate form provided that it can exert a braking force on a supported spool which resists rotation of the spool. For example, the braking arrangement may include a braking contact in the form of a brake shoe which is urged radially outwards so as to contact the core of the spool support.

In use, the friction between the braking contact 42 and the core 31 of the spool 32 constitutes a braking force which is applied to the supply spool to resist rotation of the supply spool.

As previously discussed, the braking of the supply spool may be advantageous in certain embodiments of tape drive because it enables the tension of the tape in the tape path between the supply spool and take-up spool to be increased. In the case where the tape drive is a drive which drives printing ribbon within a printer, such tension within the print ribbon may be desirable so as to ensure satisfactory printing quality.

Figure 4:
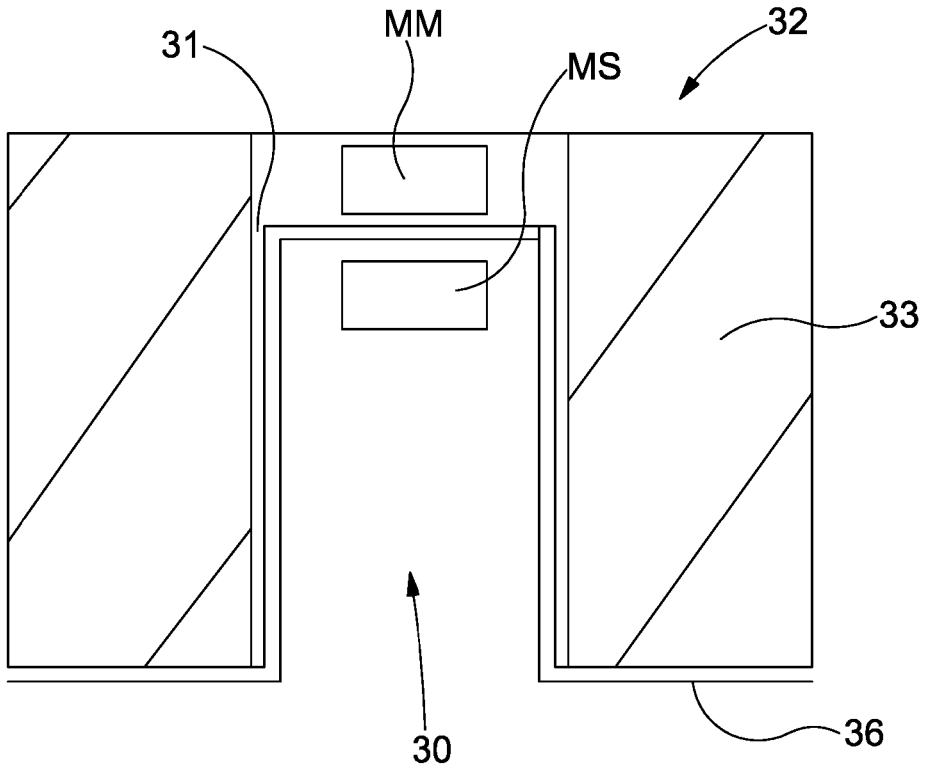
FIG. 4 shows a schematic cross-sectional view of a further embodiment of the invention.

In another embodiment of the present invention, such as that shown in FIG. 4, the braking arrangement of the supply spool may include a magnetic source. Such a magnetic source may be a permanent magnet or a selectively energisable electro-magnet. Any appropriate magnetic source may be used provided it is capable of producing a magnetic field.

An example of supply spool including a braking arrangement having a magnetic source is one in which a permanent magnet is fixed to the supply spool support of any appropriate location, such as, for example, at the end of the supply spool furthest from the base plate and/or at a point inside a circumferential surface of the spool support. The magnetic source is mounted to the spool support so that it is not free to rotate, for example, such that it is fixed against rotation relative to the spool support.

A magnetic member which is susceptible to experiencing a force exerted on it by the magnetic source is mounted to the supply spool at a location such that the magnetic member can effectively have a force exerted on it by the magnetic source. For example, in the case where the magnetic source MS is located at the end of the supply spool support 30 which is located furthest from the base plate 36, the spool 32 (and, in particular the core 31) may take the general form of a closed cylinder (i.e. which is closed at one end) and the magnetic member MM may be mounted to the spool at the closed end. In an example in which the magnetic source is located inside the circumferential surface of the supply spool support, the magnetic member may be located at a corresponding position (when the spool is supported by the spool support) adjacent the internal circumferential surface of the core of the spool.

As previously mentioned, the magnetic member may take any appropriate form which is susceptible to having a magnetic force exerted on it by the magnetic source. For example, the magnetic member may be a permanent magnet or may be formed from a ferromagnetic material.

In some embodiments it is preferable that the magnetic member is formed from a ferromagnetic material as opposed to being formed as a permanent magnet. The reason behind this is that it may cost more to incorporate a permanent magnet into the spool (as compared to incorporating a ferromagnetic member into the spool). As previously discussed, it is common practice that the tapes (and supporting cores) used within a tape drive are a consumable item. Consequently, in some embodiments, anything that can be done to minimise the cost of the tape/spools may be beneficial.

In use, the magnetic source of the braking arrangement exerts a magnetic force on the magnetic member which may constitute a braking force of the type previously discussed. The magnetic force exerted by the magnetic source on the magnetic member may in itself constitute a braking force between the supply spool support and the supply spool which resists relative rotation therebetween. Alternatively, or in addition, the magnetic force exerted by the magnetic source on the magnetic member may result is friction between the spool support and supported spool, and the friction may itself constitute a braking force. For example, in the previously discussed embodiment in which a magnetic source is located at the end of the spool support and the corresponding magnetic member is located in the closed end of a supported spool, the magnetic source may exert a magnetic force on the magnetic member such that the enclosed end of the spool is attracted towards the end of the spool support in which the magnetic source is located. This attractive force will cause the closed end of the spool to be urged against the end of the spool support. The closed end of the spool being urged into contact with the end of the spool support will increase the frictional force between the spool support and the supported spool which results from the aforementioned contact. The increased frictional force may constitute the aforementioned braking force.

In some embodiments the magnetic source may be an electro-magnet. As is well known, the current provided to the electro-magnet is related to the magnetic force produced by the electro-magnet (i.e. the magnetic force exerted on the magnetic member) such that an increase in current supplied to the electro-magnet results in an increase in the magnetic force produced by the electro-magnet. As such, it will be appreciated that by controlling the current supply to the electro-magnet it is possible to control the magnetic force exerted by the magnetic source on the magnetic member, and consequently, the braking force which is exerted on the supported spool as a result of the magnetic force. An increase in magnetic force exerted by the electro-magnet on the magnetic member will, of course, result in increased braking force (A decrease in magnetic force exerted by the electro-magnet on the magnetic member will result in decreased braking force).

By being able to vary the braking force exerted on the spool support, it may be possible to adjust operating characteristics of the tape drive. For example, by increasing the braking force between the supply spool and the spool support, it may be possible to increase the tension of the tape in the tape path (and by decreasing the braking force between the supply spool and the spool support, it may be possible to decrease the tension of the tape in the tape path). Furthermore, it may be possible to increase the braking force at a desired time so as to cause the tape drive to come to a halt more quickly. In addition, it may be possible to decrease the braking force on the supply spool in order to increase the operating speed of the tape drive.

The embodiment of the invention shown in FIG. 2 also includes features according to another aspect of the present invention. That is to say, the embodiment shown in FIG. 2 includes a retainer arrangement. In the embodiment shown in FIG. 2 a retainer arrangement is formed by the elbows 46*c* of the resilient member 46. The retainer is configured to exert a retaining force on the spool 32 supported by the spool support 30 which resists removal of the spool 32 from the spool support 30. This is achieved as follows.

The spool 32 which is supported by the spool support 30 includes a core 31 having an inner face 50 which includes a step portion 52. The step portion 52 is formed between a portion of the inner face of the core which has a relatively large diameter and an adjacent portion of the inner face which has a relatively small diameter. The step portion 52 constitutes an engagement feature of the supported spool 32.

In use, when a spool is supported by the spool support (as shown in FIG. 2), the retainer arrangement prevents the supported spool from inadvertently moving along the spool support 30 away from the base plate 36. This is achieved because the retainer (in this case in the form of the elbows 46*c* of the resilient member 46) exerts a retaining force on the spool 32, and, in particular, on the engagement feature in the form of the step portion 52. This is because, as the supported spool 32 is moved in a direction which is generally parallel to axis A away from the base plate 36, the retainer (in this case in the form of the elbows 46*c* of the resilient member 46) abuts the engagement feature (in this case in the form of the step portion 52) of the supported spool 32 such that the retainer exerts a retaining force on the spool via the engagement feature 52.

In the presently described embodiment the retainer resilient member is a retainer spring. However, it would appreciated that, in other embodiments, any appropriate resilient member may be utilised as part of the retainer arrangement.

A retainer according to the present invention may be mounted to the spool support and the engagement feature may form part of the supported spool, particularly the core of the supported spool. In other embodiments a retainer according to the present invention may be mounted to the supported spool (particularly the core of the supported spool) and the engagement feature may form part of the spool support.

In the presently described embodiment the engagement feature of the supported spool is a step portion of the inner face 50 of the core 31. This may also be referred to as a shoulder portion. It will be appreciated that any appropriate engagement feature, which, in this embodiment, forms part of the supported spool may be used provided that the retainer can engage the engagement feature to exert a retaining force on the spool. For example, the engagement feature may include a flange or a recess, such as a channel. Any such flange or recess may be located on an inner face of the spool core. The flange may protrude from the remaining portion of the inner face of the core such that the diameter of the flange is less than the diameter of the portion of the inner face from which is protrudes. Conversely, the recess (for example, channel, groove or the like) may have a diameter which is greater than that of the portion of the inner face of the core and that of a portion of the inner face adjacent the recess.

It will be appreciated that in another embodiment of the invention the engagement feature may be located at a location on the spool other than the inner face of the core. For example, the engagement feature may be located at one of the axial ends of the spool core.

As previously discussed, in the present embodiment of the invention shown in FIG. 2, the retainer takes the form of a retainer spring and the retainer spring 46 has first and second ends 46*d*, each of which is secured to a base portion of the supply spool support 30 in the manner previously discussed. As such, at least a portion of the retainer spring is located within the generally cylindrical supply spool support 30 such that the retainer spring intercepts a central axis A of the spool support. In the present case, the retainer spring is a substantially planar wire spring. The plane of the retainer spring is such that the central axis A of the spool support lies within the plane of the retainer spring. In other embodiments the retainer spring may be secured to any appropriate portion of the tape drive—for example, the retainer spring may be secured to the base plate.

In the present embodiment the resilient member (in the form of wire spring 47) of the retainer arrangement is the same resilient member as that of the braking arrangement which has previously been discussed above. Whilst this is preferable because, in the embodiments of the invention including both the retainer arrangement and a braking arrangement, it reduces the number of parts of the tape drive, it will be appreciated that, in other embodiments, the resilient member of the retainer arrangement and the resilient member of the braking arrangement may be separate entities.

In other embodiments of the present invention, the retainer arrangement may include a retainer magnetic source. The retainer magnetic source may be mounted to the spool support and the support spool may include a magnetic member such that the retainer magnetic source interacts with the magnetic member so as to exert the retaining force on the spool which resists removal of the spool from the spool support.

The configuration of the magnetic source and corresponding magnetic member which form part of the retainer arrangement are the same as discussed above in relation to the magnetic braking arrangement. As such, unnecessary repetition of the configuration of an appropriate magnetic source and corresponding magnetic member is avoided.

In some embodiments which include both a magnetic braking arrangement and a magnetic retainer arrangement, the magnetic source and corresponding magnetic member for each of the arrangements may be one and the same. In other embodiments the magnetic source and corresponding magnetic member of each of the arrangements may be different.

As previously discussed, known tape spools tend to come pre-wound. It will be appreciated that, for a given orientation of tape spool, the tape will be wound onto it in either a clockwise fashion or anti-clockwise fashion. If the orientation of the tape spool is then changed (i.e. such that the tape spool is inverted along its central axis), then the direction of the wound tape will appear reversed. The applicant has discovered that the operators of some tape drives may inadvertently mount a wound spool of tape onto a spool support of the tape drive in an incorrect orientation. If this is the case then the incorrectly mounted spool of tape will unwind in an opposite direction to that desired. This may result in undesirable effects when such a tape drive is operating. For example, if a supply spool of a tape drive is mounted in the incorrect orientation, as tape is unwound from the supply spool then the tape on the supply spool may not unwind as readily as if the supply spool is in the correct orientation, and/or the tape path may be caused to alter such that the tape path travels along an undesirable path—such that it impinges upon other components of the tape drive in an undesirable manner. In addition, if the tape is a print ribbon which has ink only on one side of the tape, then if tape is unwound from the supply spool in the wrong direction then the ribbon will pass the printhead so that the wrong side of the print ribbon is adjacent the printhead—this will reduce the quality of the print, or prevent printing altogether.

One way of addressing the problem of incorrect alignment of a spool when it is mounted on a spool support of a tape drive is to produce a spool having a core which is closed at one end. In this way, it is only possible to mount the spool to the spool support in the (correct) orientation which enables the spool support to be inserted into the open end of the core/spool.

However, it is common for tape spools which are pre-wound for use in tape drives to be pre-wound on a winding machine which concurrently winds a large number of spools. This is achieved by mounting a plurality of spool cores to a single mandrel such that respective tape can be wound onto each of the cores simultaneously.

It will be appreciated that if a core is closed at one end then it will not be possible to simultaneously mount a plurality of such cores onto the mandrel of a pre-winding machine—a mandrel cannot pass through a closed end of each core.

The spool support and corresponding tape spool shown in FIG. 2 shows an embodiment of the present invention which provides a way of preventing incorrect orientation of the tape spool onto the spool support whilst still enabling a conventional pre-winding machine to pre-wind a plurality of the spools simultaneously.

FIG. 2 shows a tape spool 32 suitable for being driven by a tape drive. The tape spool 32 comprises a length of tape 33 wound around an outer face 54 of a generally annular central core 31. In the present embodiment the outer face 54 of the core 31 has a diameter relative to a central axis A which is substantially constant. The core 31 also has an inner face 50. The inner face 50 is radially (relative to the axis A) inboard of the outer face 54. The inner face 50 comprises a first portion 56 and second portion 58. The first and second portions 56, 58 are spaced along the central axis A of the core. The diameter (relative to the central axis A) of the first portion 56 of the inner face 50 is greater than the diameter of the second portion 58 of the inner face 50.

The spool is configured such that an alignment feature may be received by the first portion 56 of the inner face 50, whereas the alignment feature cannot be received by the second portion 58 of the inner face 50. In the present embodiment the alignment feature of the spool support takes the form of a stepped base portion 60 of the spool support 30. In other embodiments the alignment feature may take any appropriate form. The stepped base portion 60 of the spool support 30 is located at the base of the spool support—i.e. at the end of the spool support closest to the base plate 36. In other words, the base portion 60 of the spool support 30 is located between the base plate 36 and the remaining portion of the spool support.

The diameter of the base portion 60 of the spool support 30 has a diameter (relative to the central axis A) which is greater than the diameter of the remaining, main portion 62 of the spool support. The diameter of the base portion 60 is chosen such than it is greater than the diameter of the second portion 58 of the inner face 50. Furthermore, the diameter of the base portion is less than the diameter of the first portion 56 of the inner face 50. The diameter of the main portion 62 of the spool support 30 is less than the diameter of the second portion 58 of the inner face 50. It follows that the main portion 62 of the spool support 30 can be received by (i.e. will pass through) both the first and second portions 56, 58 of the inner face 50. To the contrary, a stepped base portion 60 of the spool support 30 can only be received by the first portion 56 of the inner face and not by the second portion 58 of the inner face 50.

Because the alignment feature (in this case in the form of a stepped base portion 60) can be received by the first portion 56 of the inner face 50 of the spool 30 the spool and spool support cooperate such that the spool support can fully support the spool 30 in a first relative orientation between the spool in the spool support in which the alignment feature 60 is received by the first portion 56 of the inner face 50 (as shown in FIG. 2). However, because the alignment feature cannot be received by the second portion 58 of the inner face 50 of the spool 30, the spool support 30 is prevented from fully supporting the spool 32 in a second relative orientation between the spool and the spool support (such as an orientation in which the spool is inverted vertically as compared to its orientation shown in FIG. 2).

It follows from the above that the features of the spool and corresponding spool support according to embodiments of the present invention prevent incorrect orientation of the spool relative to the spool support when mounting the spool to the spool support so that the spool can be supported by the spool support. Preventing incorrect orientation between the supported spool and the spool support is beneficial because it prevents the issues discussed above which occur when such incorrect orientation of the spool relative to the spool support occurs.

The tape spool also includes a retention portion 52 (also referred to as an engagement portion—as discussed above) which is configured to exert a retaining force on the spool 32 when the spool 32 is supported by a spool support 30 which includes a retainer arrangement which resists removal of the spool 32 from the spool support 30. The way in which the retainer arrangement of the spool support cooperates with the engagement feature of the spool so as resist removal of the spool from spool support has previously been discussed and, as such, further explanation of this point is not included so as to avoid repetition.

The retention portion of the spool 32 comprises a third portion 64 of the inner face 50. The third portion 64 is spaced along the central axis A from the first and second portions 56, 58. The third portion has a diameter (relative to the central axis A) which is greater than at least one of the diameter of the first portion of the inner face 56 and the diameter of the second portion of the inner face. In this particular embodiment, the third portion has a diameter which is greater than the diameter of the second portion 58 of the inner face 50, but less than the diameter of the first portion 56 of the inner face 50. As discussed, the third portion 64 of the inner face 50 constitutes an engagement feature. The third portion 64 of the face 50 is therefore configured to receive a retainer 48 of the spool support 30 when the spool 32 is supported by the spool support in the manner discussed earlier within this document.

The second portion 58 of the inner face 50 is located intermediate the first and third portions 56, 64 of the inner face 50 with respect to their positions along the central axis A of the core/spool.

As discussed above in relation to various possible retainer arrangements which constitute embodiments of the present invention, the retainer arrangement may utilise a magnetic source to provide the retention force. In particular, the retainer of the spool support may comprise a magnetic source or a ferromagnetic material. The magnetic source or ferromagnetic material are configured to interact with a magnetic member associated with the spool support so that said interaction exerts said retaining force on the spool when the spool is supported by the spool support. Of course, the retaining force acts so as to retain the spool on the spool support, thereby resisting removal of the spool from the spool support. Depending on whether the retainer comprises a magnetic source or a ferromagnetic material, the magnetic member associated with the spool support takes the form of a second ferromagnetic member (for example, when the retainer feature comprises a magnetic source) or a second magnetic source (for example, when the retainer feature comprises a ferromagnetic material). The interaction between the magnetic retainer feature and the magnetic member exerts the retaining force on the spool when the spool is supported by the spool support.

In the previously described embodiment the core 31 of the spool is solid—that is to say, material fills the entire space between the outer face of the core 54 and the inner face 50 of the core. In other embodiments, this may not be the case. For example, in some embodiments, the core may be hollow (i.e. such that there is air between the inner and outer faces of the core).

Figure 3:
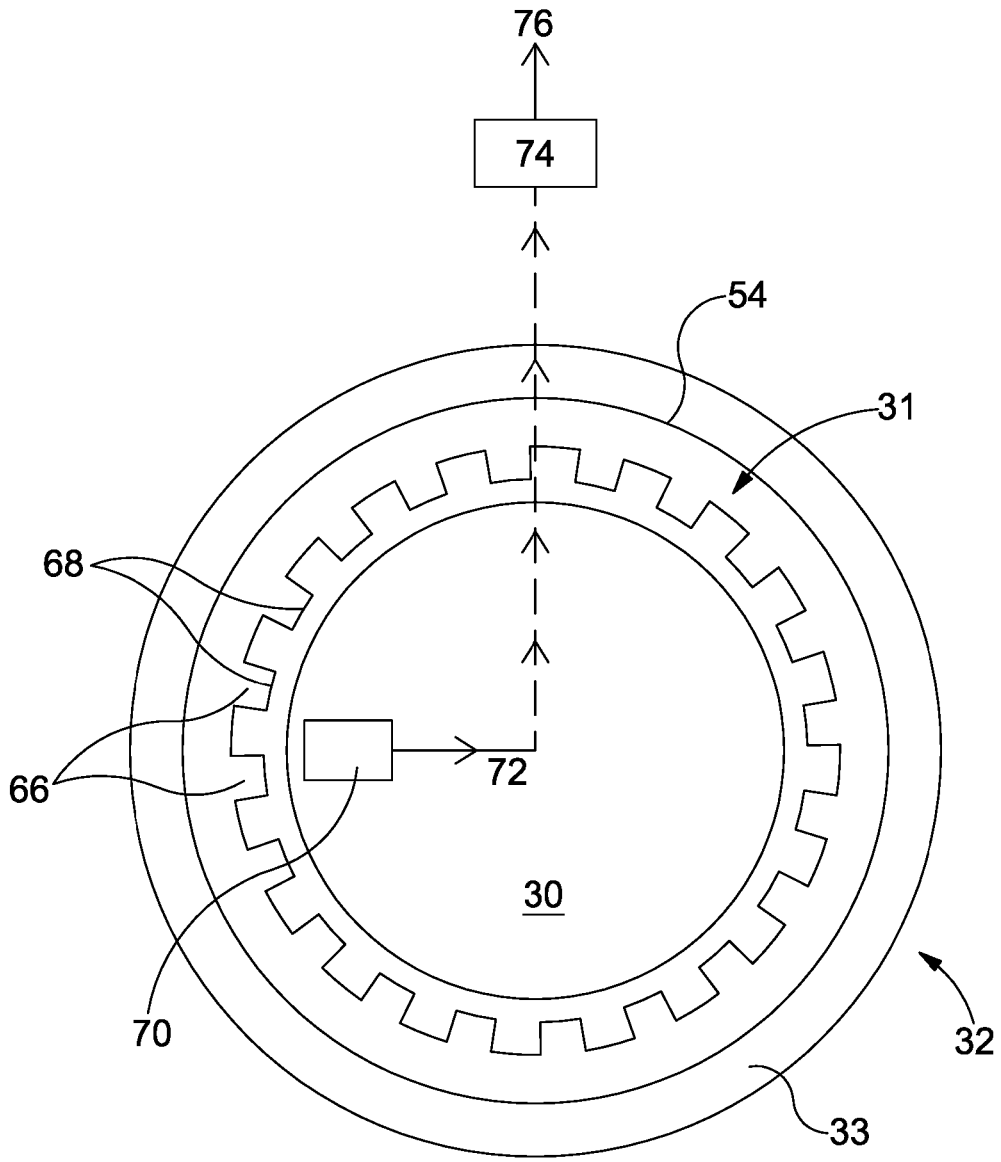
FIG. 3 shows a schematic overhead view of a portion of a tape drive according to various embodiments of the present invention.

In other embodiments, such as that shown in FIG. 3, the spool comprises a plurality of ribs 66 which extend in a generally radial direction inwards (i.e. away from the outer face 54) to a respective radially inner end 68. In some embodiments the radially inner end 68 of each of the ribs is connected to an inner annular portion of the core which defines the inner face of the core. In other embodiments the inner face of the core 31 may be a discontinuous surface which is defined by the radially inner ends of each of the plurality of ribs 66 themselves.

In embodiments in which the inner face of the core 31 is a discontinuous surface defined by the radially inner ends of the ribs it will be appreciated that it may be disadvantageous for a braking contact or a retainer to contact the inner ends of the ribs—as each of the ribs in turn pass the braking contact or a retainer this may cause vibration which may increase wear, cause an undesirable noise and/or result in jerky movement of the supported spool. As such, in embodiments in which the inner face of the core 31 is a discontinuous surface defined by the radially inner ends of the ribs it may be beneficial for the spool support and supported spool to be configured such that the braking contact and/or the retainer (as appropriate) contact a portion of the spool core other than an inner face of the core. For example, in some embodiments the braking contact and/or the retainer (as appropriate) may contact an axial end of the core of a supported spool. In addition or alternatively, the portion of the core contacted by the braking contact and/or the retainer (as appropriate) may be a portion which is a continuous surface which has a constant radius.

It will be appreciated that, in order for an embodiment which includes ribs to have an inner face having a profile such as that shown in FIG. 2, the profile of the ribs when viewed in a plane which contains the central axis A will necessarily match the profile defined by the inner and/or outer faces of the core 31.

According to another aspect of the invention, there is provided a tape drive comprising a spool support of any of the types previously discussed, wherein the spool support 30 additionally comprises a sensor 70 configured to produce a sensor signal 72 based on the rotation of the spool 32 relative to the spool support 30. The sensor may be any appropriate sensor which is capable of producing a sensor signal based on the rotation of the spool relative to the spool support. For example, the sensor may be a rotary encoder, a magnetic sensor, capacitive sensor, or an optical sensor.

The tape drive further comprises a controller 74. The controller is configured to receive the sensor signal 72 and, based on the sensor signal 72, to produce an output signal 76. The output signal 76 may be a signal which is indicative of a fault condition if the sensor signal is indicative of the speed of rotation of the spool 32 being outside of a target range. For example, if the sensor signal 72 produced by the sensor 70 is indicative of the speed of rotation of the spool being zero (or close to zero) at a time when the motive device of the tape drive is attempting to move the tape along the tape path, then this may be indicative of the tape having snapped and/or the spool having become jammed on the spool support such that it cannot rotate. Clearly either of these situations occurring will adversely affect the operation of the tape drive. Consequently, it may be advantageous for the controller to produce said signal 76 indicative of a fault condition so that the fault can be rectified.

In addition, or alternatively, the output signal 76 produced by the controller 74 may be a signal indicative of a spool empty condition when the sensor signal is indicative of the speed of rotation of the spool support being outside of a particular target range. For example, if the speed sensor is monitoring the speed of rotation of a supply spool, as tape from the supply spool is used up, the radius of the supply spool will decrease. Consequently, for a given linear speed of tape along the tape path, the speed of rotation of the supply spool will increase. As such, in some embodiments, when the speed of rotation of the supply spool measured by the sensor 72 is greater than a predetermined speed (which corresponds to a speed of rotation of the spool when the spool is nearly empty), the controller can output said signal which is indicative of a spool low/nearly empty condition.

The sensor 70 may be configured such that the produced sensor signal 72 is a function of a rotationally salient feature passing the sensor as the spool rotates relative to the spool support. The rotationally salient feature may be any appropriate rotationally salient feature which can be detected by the sensor 70. For example, in some embodiments, the rotationally salient feature may be a magnet located at a particular position around the circumference of the core 31. If the sensor is a magnetic sensor (such as, for example, a Hall Effect sensor) then, as the magnet of the core passes the sensor 70 whilst the spool rotates, the passage of the magnet past the sensor 70 will be detected.

In the embodiment shown in FIG. 3 the rotationally salient feature is a plurality of ribs 66 which are angularly spaced from one another about the rotational axis of the spool. As such, in this embodiment, the sensor 70 produces the sensor signal 72 based on the passage of each of the ribs 66 past the sensor. An example of a sensor which may be able to detect such rotationally salient features of the core is a capacitive sensor. The capacitance sensed by the capacitive sensor will differ when a rib is present adjacent the sensor as compared to when a rib is not present adjacent the sensor. As a further alternative, the sensor may be some form of optical sensor which detects the presence or otherwise a rib adjacent the sensor. Such an optical sensor may be configured to detect light reflected by the ribs. Alternatively, the ribs may at least partially obscure the sensor such that less light is received by the sensor when a rib is adjacent to it. The sensor may comprise its own source of light, part of which is detected by the sensor, or the sensor may detect a portion of ambient light which reaches it.

It is common for known tape drives to include a take up spool support and a supply spool support which are substantially the same size. Furthermore, it is common for known tape drives to, via respective take up spool and supply spool supports, support a take up spool and a supply spool which have cores which are of the same diameter. Specifically, the inner diameter of the core of the supply spool and the inner diameter of the core of the take up spool may be the same; and the outer diameter of the core of the supply spool and the outer diameter of the core of the take up spool may be the same.

A common internal diameter of the cores used with known tape drives is about 1 inch (about 2.54 cm). It is also common for pre-wound supply spools for use with known tape drives to be wound with certain common lengths of tape: for example, 400 m, 600 m and 800 m.

The applicant has determined that in some applications of the present invention it may be beneficial for the supply spool core to be 'oversized' when compared to known supply spool cores. In particular, the applicant has determined that in said applications it is beneficial for the outer diameter of the supply spool core to be 'oversized' when compared to that of known supply spool cores.

The reason behind this determination is that, as previously discussed, in embodiments of the invention which include a supply spool support including a braking arrangement, the braking arrangement may be used to maintain tension in the tape in the tape path within predetermined operating limits. In order to achieve this, the braking arrangement applies a braking force to the supply spool, which is manifested as a braking torque on the supply spool. The braking torque results in a force being applied to the tape in the tape path which acts in a direction opposite to the direction of movement of the tape along the tape path and results in tension within the tape in the tape path. The force applied to the tape in the tape path (which acts in a direction opposite to the direction of movement of the tape along the tape path), and hence the tension within the tape in the tape path, is dependent upon the braking torque and the distance between the axis of rotation of the supply spool and outer radius of the supply spool (i.e. the outer radius of the tape wound on the supply spool). In particular, ignoring frictional forces and the like, the force applied to the tape in the tape path as a result of the braking force is equal to the braking torque divided by the outer radius of the supply spool.

For a spool, for a given length of tape wound onto a core, the greater the outer diameter of the core, the smaller the difference between the outer diameter of the spool when all of the length of tape is wound onto the core and that when all of the tape has been wound off the core. As discussed above, the tension in the tape in the tape path is dependent on the radius (or diameter) of the supply spool. As such, by reducing the difference between the outer diameter of the spool when all of the length of tape is wound onto the core and that when all of the tape has been wound off the core, using a core having a greater diameter will result in a tape drive in which the difference in the tension in the tape in the tape path between when all of the length of tape is wound onto the core and when all of the tape has been wound off the core is reduced. Put another way, using a supply spool core having a greater diameter will result in a tape drive in which the tension in the tape in the tape path is more constant throughout the lifetime of the tape as tape is wound from the supply spool onto the take up spool.

It will be appreciated that in some applications, such as when the tape drive forms part of a printing apparatus, it may be advantageous for the tension within the tape to be as constant as possible throughout the lifetime of the tape as tape is wound from the supply spool onto the take up spool. In the case of a printing apparatus, for example, this is because a change in tension may result in a change in print quality—hence, in the absence of other factors, relatively consistent print ribbon tension results in relatively consistent print quality.

In some embodiments the outer diameter of the core of the supply spool may be chosen such that, for a given length of tape to be wound onto the supply spool for the supply spool to be fully pre-wound, the outer diameter of the supply spool when all the tape has been wound off the supply spool is about 50% or more of the outer diameter of the supply spool when the supply spool is fully pre-wound. Put another way, in some embodiments, the outer diameter of the core of the supply spool may be chosen such that the outer diameter of the supply spool at the end of use of the supply spool within the tape drive is about 50% or more of the outer diameter of the supply spool at the beginning of use of the supply spool within the tape drive.

This is equivalent to saying that in some embodiments the outer diameter of the core of the supply spool may be chosen such that, for a given length of tape to be wound onto the supply spool for the supply spool to be fully pre-wound, the outer diameter of the supply spool when the supply spool is fully pre-wound is about 200% or less of the outer diameter of the supply spool when all the tape has been wound off the supply spool. Put another way, in some embodiments, the outer diameter of the core of the supply spool may be chosen such that the outer diameter of the supply spool at the beginning of use of the supply spool within the tape drive is 200% or less of the outer diameter of the supply spool at the end of use of the supply spool within the tape drive.

In one embodiment, the outside diameter of a wound supply spool is 73 mm and the outside diameter of the supply spool core is 44 mm. In this case the diameter ratio between start and end of supply spool (i.e. between the beginning of use of the supply spool and the end of use of the supply spool) is 1.66. That is to say the outer diameter of the supply spool at the beginning of use of the supply spool within the tape drive is 166% of the outer diameter of the supply spool at the end of use of the supply spool within the tape drive This is equivalent to about a 66% change in tension within the tape during the lifetime of the tape within the tape drive. This compares to a 120% change in tension within the tape during the lifetime of a known supply spool within a tape drive.

In some embodiments of the invention the core of a supply spool may be sized such that its internal diameter is greater than 1 inch. In some embodiments of the invention the core of the supply spool may have a greater outer diameter than the outer diameter of the core of the take up spool. In some embodiments of the invention the cores of the take up spool and of the supply spool may have the same internal diameter, but the core of the supply spool may have an outer diameter which is greater than the outer diameter of the core of the take up spool.

The invention claimed is:

1. A tape drive of a printing apparatus, the tape drive comprising:

a spool support for supporting a tape spool, wherein the spool support comprises a support surface mounted to a tape drive base plate such that the support surface is fixed against rotation relative to the tape drive base plate, the support surface being configured such that, in use, as tape is removed from or wound onto a spool, the spool rotates relative to the spool support such that the spool rotates around the support surface; and a resilient member including a first portion positioned within the spool support and a second portion that protrudes beyond the spool support, said second portion configured to contact a portion of the tape spool.

2. A tape drive according to claim 1, wherein the spool support is a supply spool support for supporting a supply tape spool and wherein the supply spool support includes a braking arrangement, the braking arrangement being configured to apply a braking force to the supply spool and thereby resist relative rotation between the supply spool and the supply spool support.

3. A tape drive according to claim 2, wherein the braking arrangement includes a braking contact which is configured to contact a portion of a supply spool supported by the supply spool support to thereby apply said braking force to the supply spool.

4. A tape drive according to claim 3, wherein the braking contact is formed from a material which is more hard than the material from which the portion of the supply spool contacted by the braking contact is formed such that, in use, the braking force causes the portion of the supply spool contacted by the braking contact to wear in preference to the braking contact.

5. A tape drive according to claim 1, wherein the resilient member is supported by the spool support and wherein the resilient member is a planar wire spring.

6. A tape drive according to claim 1, wherein the spool support is generally cylindrical, extending along a central axis.

7. A tape drive of a printing apparatus, the tape drive comprising:

a generally cylindrical spool support for supporting a tape spool and extending along a central axis, wherein the spool support comprises a support surface mounted to a tape drive base plate such that the support surface is fixed against rotation relative to the tape drive base plate, the support surface being configured such that, in use, as support such that the spool rotates around the support surface;

wherein a spring has first and second ends, each of which is secured to a base portion of the supply spool support or the base plate such that at least a portion of the spring is located within the generally cylindrical supply spool support and such that the plane of the spring passes through the central axis of the generally cylindrical supply spool support.

8. A tape drive according to claim 2, wherein the braking arrangement includes a magnetic source.

9. A tape drive according to claim 8, wherein the magnetic source is an electromagnet, and wherein a current supplied to the electromagnet is controllable so as to vary the magnetic force produced by the electromagnet and thereby vary the braking force exerted on the supply spool.

10. A tape drive according to claim 1, further comprising a retainer arrangement, the retainer arrangement comprising a retainer, the retainer being configured to exert a retaining force on a spool supported by the spool support which resists removal of the spool from the spool support.

11. A tape drive according to claim 10, wherein the retainer is configured to engage an engagement feature of a supported spool to exert said retaining force on the spool which resists removal of the spool from the spool support.

12. A tape drive according to claim 10, wherein the spool support is generally cylindrical, extending along a central axis.

13. A tape drive according to claim 10, wherein the retainer comprises at least one of a resilient member and a retainer spring.

14. A tape drive of a printing apparatus, the tape drive comprising:

a spool support for supporting a tape spool, wherein the spool support comprises a support surface mounted to a tape drive base plate such that the support surface is fixed against rotation relative to the tape drive base plate, the support surface being configured such that, in use, as tape is removed from or wound onto a spool, the spool rotates relative to the spool support such that the spool rotates around the support surface; and a retainer arrangemnet comprising a retainer, the retainer being configured to exert a retaining force on a spool supported by the spool support which resists removal of the spool from the spool support;

wherein the retainer is a retainer spring and the retainer spring has first and second ends, each of which is secured to the base plate or a base portion of the spool support such that at least a portion of the retainer spring is located within the generally cylindrical spool support and such that the retainer spring intersects a central axis of the spool support.

15. A tape drive device according to claim 13, wherein the resilient member of the retainer arrangement is one and the same as the resilient member of a braking arrangement.

16. A tape drive according to claim 1, wherein the supply spool includes a core around which tape material is wound, wherein the tape drive further comprises a braking arrangement including a braking contact based on the second portion of the resilient member configured to contact an inner face of the core of the supply spool supported by the supply spool support to thereby apply a braking force to the supply spool to reduce a speed of rotation of the supply spool.

17. A tape drive according to claim 1, wherein the resilient member is a substantially planar wire spring and wherein the second portion of the substantially planar wire spring includes two opposed elbow portions that are configured to apply a braking force to the portion of the tape spool.

18. The tape drive according to claim 17, wherein the spool support defines a pair of diametrically opposed openings through which the two opposed elbow portions of the second portion of the resilient member protrude beyond the spool support.

19. A tape drive according to claim 1, wherein the resilient member is a retainer of a retainer arrangement, wherein the second portion of the resilient member is configured to exert a retaining force on the tape spool supported by the spool support to resist removal of the tape spool from the spool support;

and wherein the supply spool includes a core around which tape material is wound, wherein the core has an inner face that includes a step portion formed between a portion of the inner face with a first diameter and an adjacent portion of the inner face with a second diameter less than the first diameter, wherein the retainer is configured to engage the step portion of the core to exert said retaining force on the tape spool which resists removal of the tape spool from the spool support.

* * * * *